US011253739B2

(12) United States Patent
Freeman

(10) Patent No.: US 11,253,739 B2
(45) Date of Patent: Feb. 22, 2022

(54) FLOOR OR GROUND BASED APPARATUS SUPPORTING EXERCISE ACTIVITIES

(71) Applicant: Lorin Michael Freeman, Poquoson, VA (US)

(72) Inventor: Lorin Michael Freeman, Poquoson, VA (US)

( * ) Notice: Subject to any disclaimer, the term of this patent is extended or adjusted under 35 U.S.C. 154(b) by 31 days.

(21) Appl. No.: 16/882,581

(22) Filed: May 25, 2020

(65) Prior Publication Data

US 2021/0093910 A1 Apr. 1, 2021

Related U.S. Application Data

(60) Provisional application No. 62/907,752, filed on Sep. 30, 2019.

(51) Int. Cl.

| | |
|---|---|
| ***A63B 21/04*** | (2006.01) |
| ***A63B 21/16*** | (2006.01) |
| ***A63B 21/055*** | (2006.01) |

(52) U.S. Cl.

CPC ..... *A63B 21/04* (2013.01); *A63B 21/0552* (2013.01); *A63B 21/16* (2013.01); *A63B 2225/09* (2013.01)

(58) Field of Classification Search

CPC ..... A63B 21/0728; A63B 21/00061; A63B 21/00065; A63B 21/00069; A63B 21/075; A63B 21/4043; A63B 21/0552; A63B 23/0405; A63B 23/1209; A63B 23/1218; A63B 23/1245; A63B 21/0724; A63B 2023/006; A63B 2023/0411

See application file for complete search history.

(56) References Cited

U.S. PATENT DOCUMENTS

| | | | | |
|---|---|---|---|---|
| 3,218,065 A * | 11/1965 | Anderson | ..... | A63B 9/00 482/148 |
| 9,675,829 B1 * | 6/2017 | Katz | ..... | F16B 7/10 |
| 2017/0144011 A1 * | 5/2017 | Gangemi | ..... | A63B 21/0724 |

* cited by examiner

*Primary Examiner* — Andrew S Lo
*Assistant Examiner* — Andrew M Kobylarz
(74) *Attorney, Agent, or Firm* — Peter J. Van Bergen

(57) ABSTRACT

An apparatus for support of exercise activities includes a frame having a first Y-shaped portion adjoining a second Y-shaped portion. The two Y-shaped portions share a common leg having opposing ends. Each of the Y-shaped portions has two outboard ends. A support member is coupled to each of the opposing ends of the common leg, each of the two outboard ends of the first Y-shaped portion, and each of the two outboard ends of the second Y-shaped portion. Each such support member is adapted to fit through a hole in a weight plate and adapted to have an exercise resistance band coupled thereto.

23 Claims, 9 Drawing Sheets

FLOOR OR GROUND BASED APPARATUS SUPPORTING EXERCISE ACTIVITIES

Pursuant to 35 U.S.C. § 119, the benefit of priority from provisional application 62/907,752, with a filing date of Sep. 30, 2019, is claimed for this non-provisional application.

FIELD OF THE INVENTION

The invention relates generally to exercise equipment, and more particularly to an apparatus that can be placed on a floor or ground surface for the support of exercise activities performed using resistance bands.

BACKGROUND OF THE INVENTION

Athletic training and general exercise routines using resistance bands have become very popular. The simplicity and versatility of resistance bands allows them to serve as part of a training foundation for many individual and team sports. Because basic resistance bands are so popular and are relatively inexpensive, many individual users own resistance bands. However, while resistance bands themselves are very simple pieces of equipment, resistance-band training systems are bulky and not easily transported, use proprietary bands, and are expensive.

SUMMARY OF THE INVENTION

Accordingly, it is an object of the present invention to provide an apparatus that can support a variety of resistance-band training exercises.

Another object of the present invention is to provide a portable apparatus adapted to have resistance bands coupled thereto for resistance band training.

Still another object of the present invention is to provide an exercise training apparatus adapted to be used with existing resistance bands and conventional weights.

Yet another object of the present invention is to provide an apparatus that can support a variety of resistance-band training exercises in both indoor and outdoor venues.

Other objects and advantages of the present invention will become more obvious hereinafter in the specification and drawings.

In accordance with the present invention, an apparatus for support of exercise activities includes a frame having a first Y-shaped portion adjoining a second Y-shaped portion. The first Y-shaped portion and second Y-shaped portion share a common leg having opposing ends. Each of the first Y-shaped portion and second Y-shaped portion has two outboard ends. A support member is coupled to each of the opposing ends of the common leg, each of the two outboard ends of the first Y-shaped portion, and each of the two outboard ends of the second Y-shaped portion. Each such support member is adapted to fit through a hole in a weight plate and adapted to have an exercise resistance band coupled thereto.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
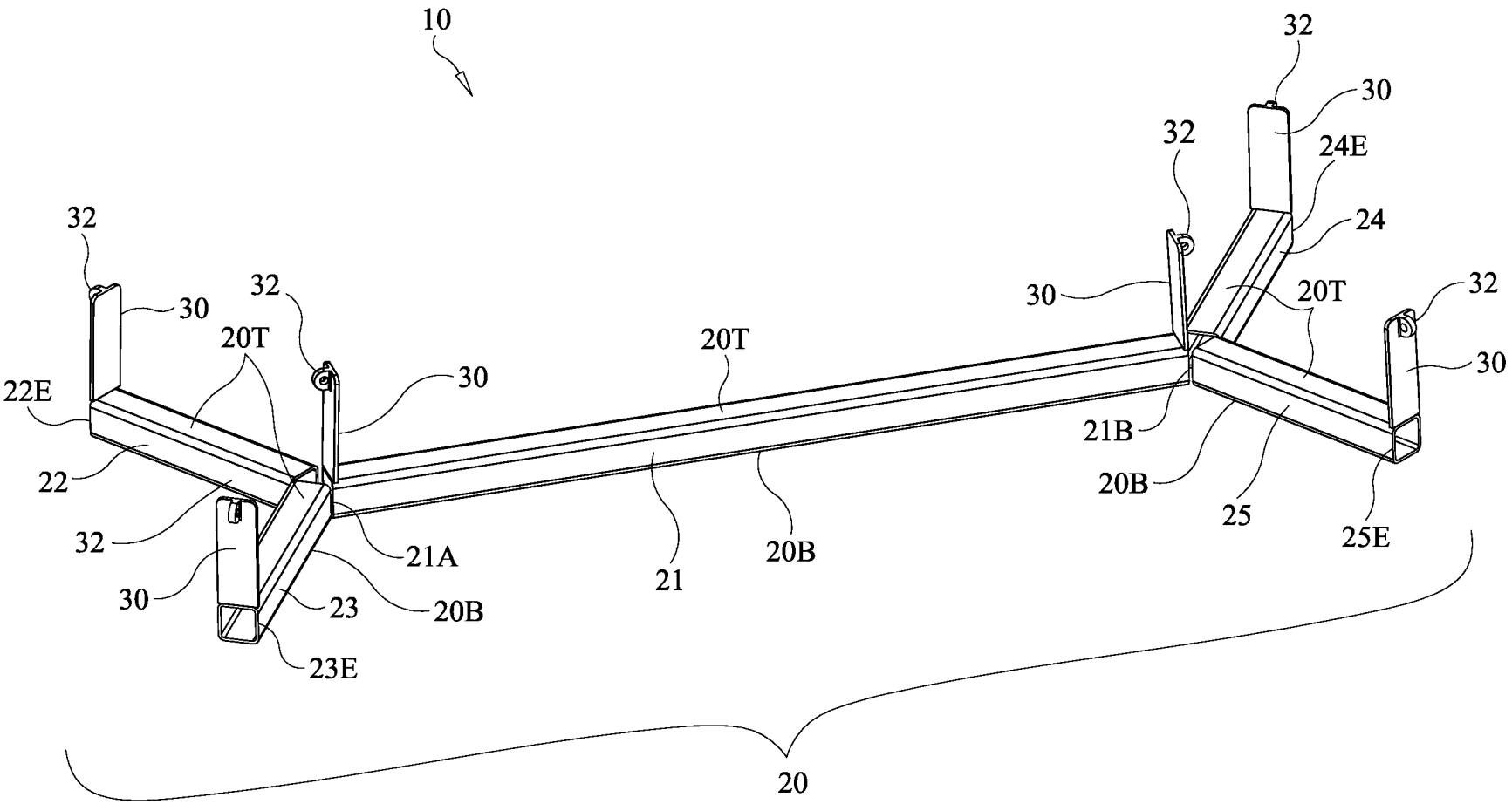
FIG. 1 is a perspective view of an apparatus for support of exercise activities in accordance with an embodiment of the present invention.

Referring now to the drawings and more particularly to FIG. 1, an apparatus for the support of exercise activities in accordance with an embodiment of the present invention is shown and is referenced generally by numeral 10. Apparatus 10 is configured for placement and use on a floor and/or on an outdoor ground surface. As will be explained further below, the present invention defines a plurality of attachment points for resistance bands (not shown). Then, when properly anchored and/or weighted down on a floor or ground surface, a user can position and/or couple the resistance bands attached to apparatus 10 relative to themselves in a way that allows them to exercise using the elasticity of the resistance bands. As will be explained further below, apparatus 10 can be weighted down using, for example, weight plates used in weight lifting exercises, cinder blocks, sand/rock or water bags, without departing from the scope of the present invention.

Apparatus 10 includes a frame 20 that includes leg members 21-25, and a plurality of weight-plate-and-resistance-band support members 30 coupled to frame 20. In general, frame 20 and support members 30 are made from strong and rigid materials to include, for example, metals and composite materials, the choices of which are not limitations of the present invention. As mentioned above, frame 20 can be placed on horizontal surface (not shown) such that there is a top 20T of frame 20 and bottom of 20B of frame relative to the horizontal surface. Top 20T and bottom 20B generally lie in parallel planes.

Frame 20 has a central spine or leg member 21 and four leg members 22-25 that are generally shorter in length than leg member 21. Each of leg members 21-25 can be rectangular in cross-section (as shown), circular in cross-section, or any other geometric cross-sectional shape without departing from the scope of the present invention. Leg members 22 and 23 are coupled to one end 21A of leg member 21 such that leg members 21-23 define a Y-shape when viewed from the top 20T of frame 20. In a similar fashion, leg members 24 and 25 are coupled to an opposing end 21B of leg member 21 such that leg members 21, 24 and 25 define a Y-shape when viewed from the top 20T of frame 20. In other words, leg member 21 is a common leg of two adjoining Y-shaped portions of frame 20. The angle defined between leg members 22/23 and 24/25 can be in a range of acute or obtuse angles without departing form the scope of the present invention. The respective outboard ends of leg members 22-25 are referenced by numerals, 22E-25E.

A support member 30 of the present invention is coupled to each of the opposing ends 21A/21B of leg member 21 and to each outbound end 22E-25E of leg members 22-25. Each support member 30 extends upward from top 20T of frame 20 and is perpendicular or approximately perpendicular to frame 20. Each support member 30 defines one or more attachment elements thereon to facilitate the attachment of a resistance band (not shown). For example, in the illustrated embodiment, each support member 30 incorporates an eye element 32 to which a resistance band can be coupled, looped through, etc. Eye element 32 can also serve as an attachment point for a linking element such as a carabiner to simplify the attachment/detachment of a resistance band.

In use of apparatus 10, a plurality of weight plates (not shown) can be placed over several or all of support elements 30 such that each weight plate rests on frame 20. More specifically, support elements 30 are sized/shaped to pass through a weight plate's central hole such that a weight plate is disposed horizontally to rest on top 20T of frame 20 and such that eye element 32 is accessible above a weight plate. The user than attaches one or more resistance bands to one or more eye elements 32 depending on the exercise that is to be performed.

Figure 2:
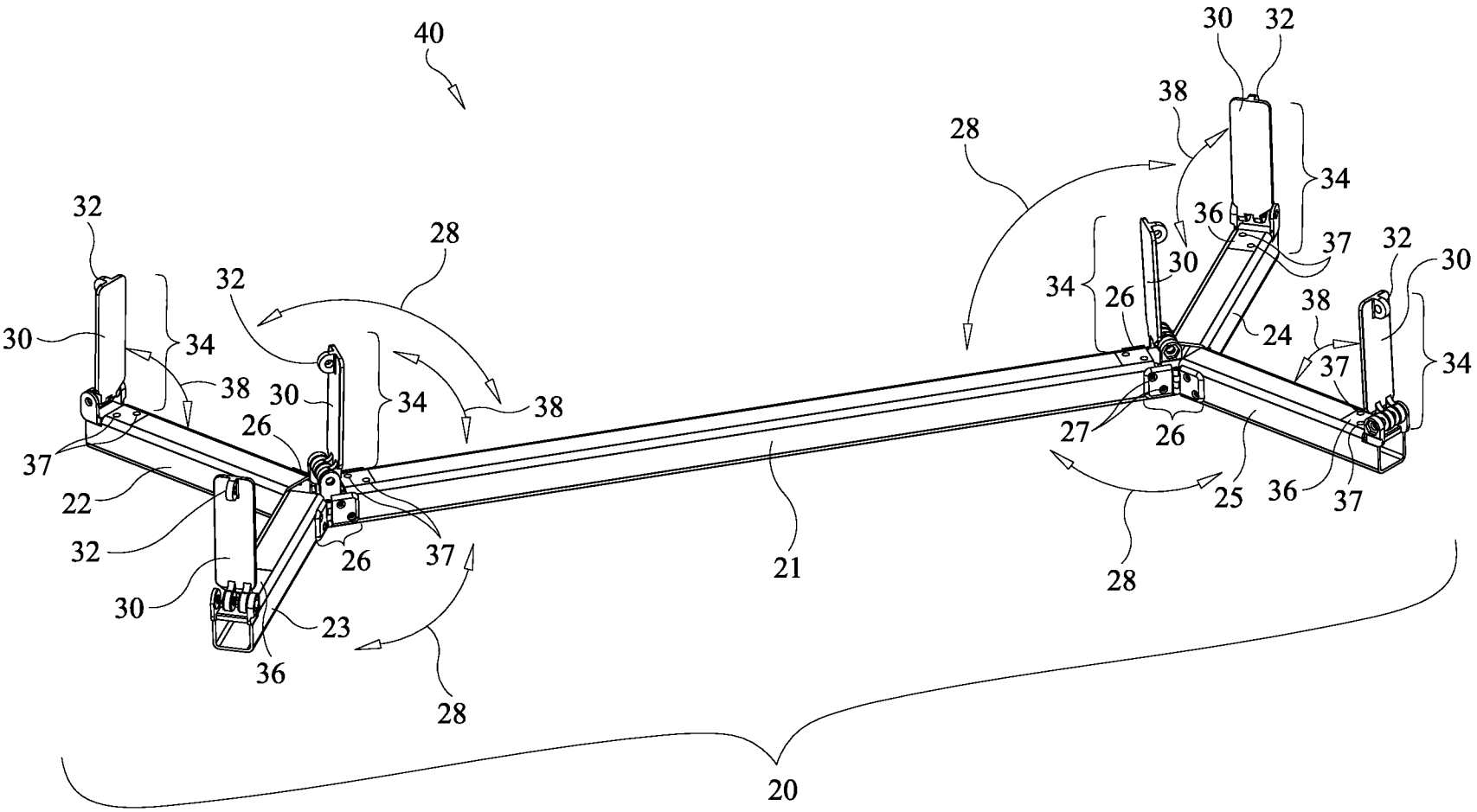
FIG. 2 is a perspective view of a collapsible and transportable apparatus for support of exercise activities in accordance with another embodiment of the present invention.

Another embodiment of an apparatus for support of exercise activities in accordance with the present invention that is configured to be collapsible and transportable is shown in FIG. 2 and is referenced generally by numeral 40. Apparatus 40 also includes leg members 21-25 and support elements 30 as described above. However, apparatus 40 also includes a plurality of hinges 26 that allow leg members 22-25 to be rotated to be adjacent to leg member 21 when apparatus 40 is to be transported. Each hinge 26 is coupled to leg member 21 and to one of leg members 22-25 using, for example, screws 27 (as shown), welding, etc. In this way, each leg member 22-25 can be rotated towards/away from leg member 21 in the plane of frame 20 as indicated by two-headed arrows 28. To assure that each leg member 22-25 can lie flat against leg member 21, the length of each leg member 22-25 should be less than half the length of leg member 21 when all leg members 22-25 are the same length.

Apparatus 40 also provides for the hinging of each support element 30 relative to frame 20 such that each support member 30 can be positioned for use of apparatus 40 (as shown in FIG. 1 and as described above) and such each support member 30 can be rotated to be adjacent to its corresponding leg member to facilitate transportation of apparatus 40. For example, each support member 30 can be a plate of a hinge 34 where the second plate 36 of hinge 34 is coupled to the top of its leg member using, for example, screws 37 (as shown), welding, etc. In this way, each support member 30 can be rotated towards away from its leg member as indicated by two-headed arrows 38.

Figure 3:
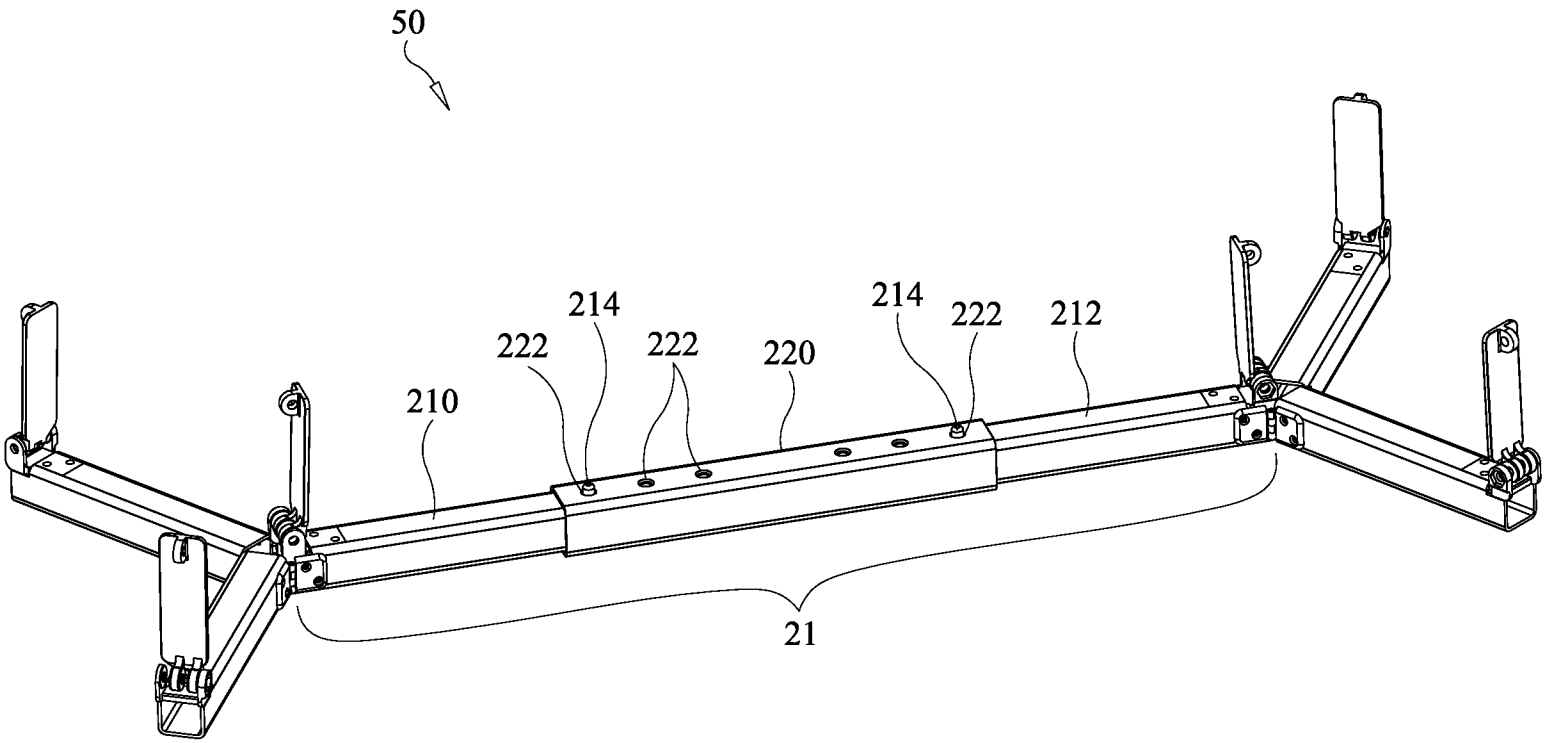
FIG. 3 is a perspective view of a collapsible and transportable apparatus for support of exercise activities that is also extendible in length in accordance with yet another embodiment of the present invention.

In another embodiment of the present invention, an apparatus 50 for support of exercise activities is illustrated in FIG. 3. Apparatus 50 can be configured similar to apparatus 10 or apparatus 40 (as shown), but include structure that allows leg member 21 to be extendible in length. For example, and in the illustrated embodiment, leg member 21 has leg segments 210 and 212 that partially extend into and slide within a hollow sleeve 220. Each segment 210 and 212 includes a spring-loaded button 214 that engages with one of holes 222 in sleeve 220 to thereby allow the user to adjust the length of leg 21.

Figure 4:
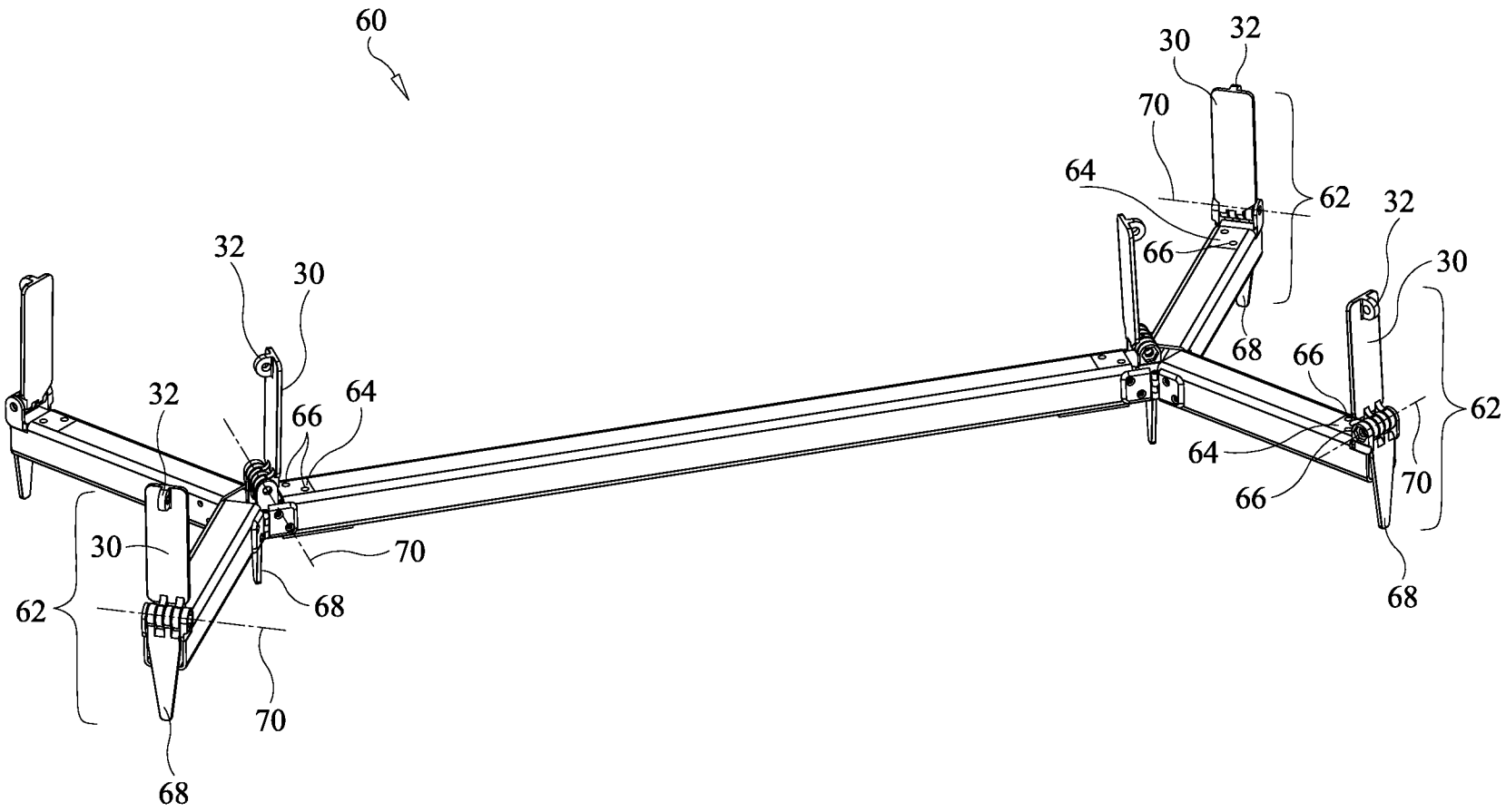
FIG. 4 is a perspective view of an apparatus for support of exercise activities that can be configured for use on a soft ground setting in accordance with still another embodiment of the present invention.

As mentioned above, the present invention can also be configured for use outdoors on soft ground surfaces. In such applications, it is desirable to prevent the apparatus of the present invention from sliding along the surface. An apparatus of the present invention configured for use on a soft ground surface is illustrated in FIG. 4 and is referenced by numeral 60. The additional features of apparatus 60 can also be incorporated into previously-described apparatus 50 without departing from the scope of the present invention.

In the illustrated embodiment, each support member 30 is one plate of three-part hinge 62 where an attachment plate 64 of hinge 62 is coupled to the top of its leg member using, for example, screws 66. A third plate 68 of hinge 62 is shaped as a spike. In the illustrated embodiment, three-part hinges 62 are used at each opposing end of leg member 21 and each outboard end of leg members 22-25. In other embodiments of the present invention, three-part hinges 62 might only be used at the outboard ends of leg members 22-25.

Each hinge 62 is configured to allow support member 30 and (spike) plate 68 to be independently rotatable about the hinge's axis of rotation 70. In this way, support members 30 can be positioned to receive a weight plate and have a resistance band coupled thereto as described above, while (spike) plates 68 are positioned to point in a direction substantially perpendicular relative to the bottom of apparatus 60 to facilitate the pressing of plates 68 into a ground region.

The above-described three-part hinges 62 can also be configured as locking hinge arrangements. An exemplary embodiment of a locking hinge arrangement is shown and will be described with simultaneous reference to FIG. 5-8. A unique three-plate locking hinge arrangement that can be used at each end of leg member 21 and on each of leg members 22-25 is shown and is referenced generally by numeral 80. In FIGS. 5-8, locking hinge arrangement 80 is shown coupled to one end of leg member 21.

Locking hinge arrangement 80 includes the above-described support member 30, attachment plate 64, and spike 68 hingedly coupled to one another along hinging axis 70. Support member 30, plate 64, and spike 68 are lockable relative to one another by a locking mechanism (not shown) incorporated along hinging axis 70 where such locking mechanism is actuated and released by a hinge locking arm 82. Such locking hinge mechanisms having an actuating/release arm are known in the art and will, therefore, not be described further herein.

Figure 5:
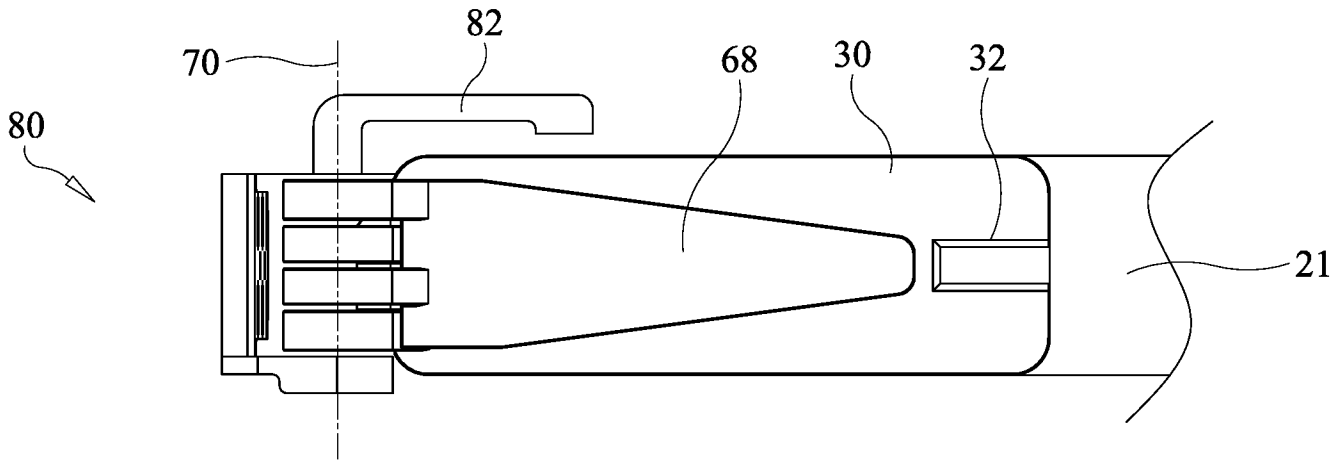
FIG. 5 is a top plan view of a portion of an apparatus for support of exercise activities illustrating a locking hinge arrangement of a weight-plate-and-resistance-band support member and soft-ground spike coupled to the apparatus' frame in accordance with an embodiment of the present invention.
Figure 6:
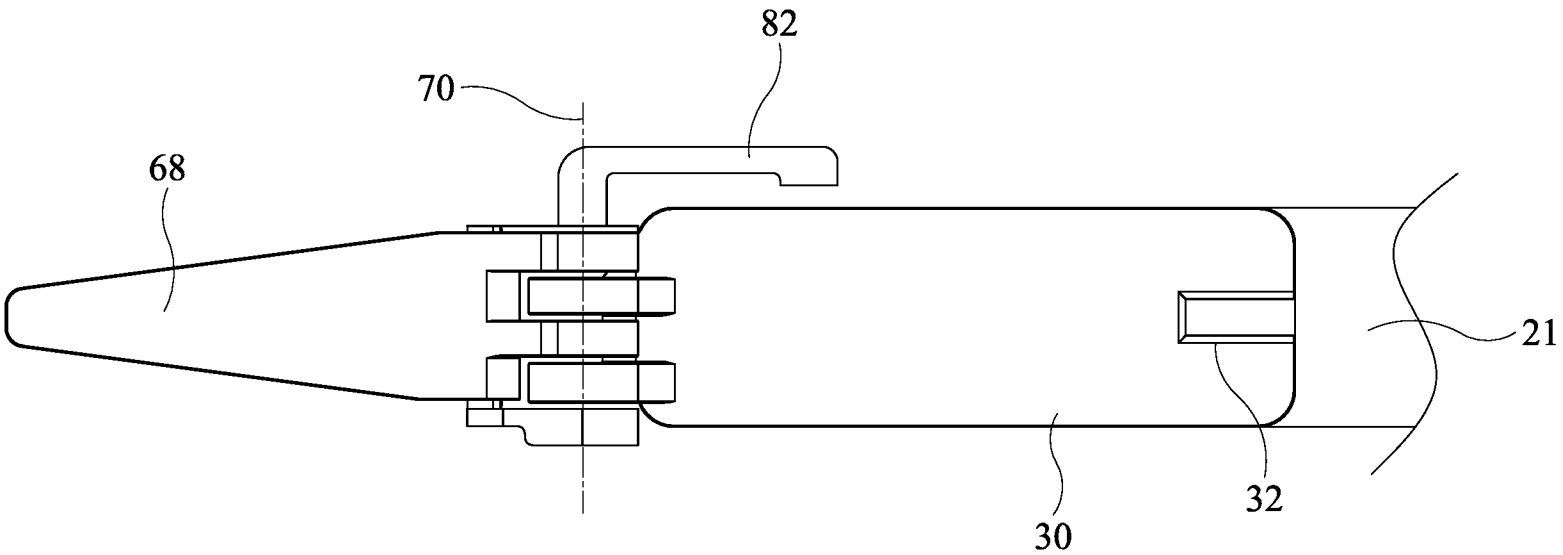
FIG. 6 is a top plan view of the locking hinge arrangement shown in FIG. 5 with the spike pivoted to be in horizontal alignment with the apparatus' frame.
Figure 7:
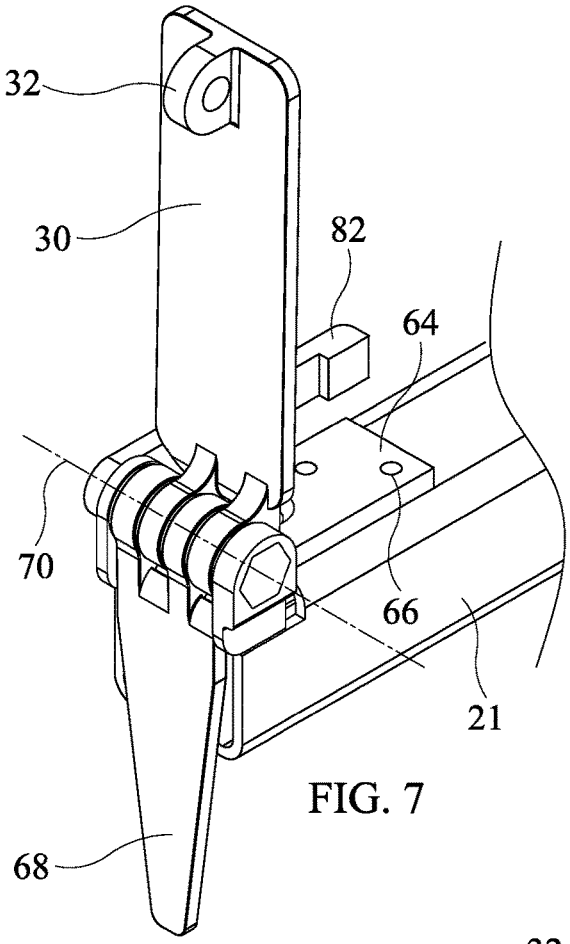
FIG. 7 is a perspective view of the locking hinge arrangement shown in FIG. 5 with the spike pivoted to a position for ready insertion into a soft ground location.
Figure 8:
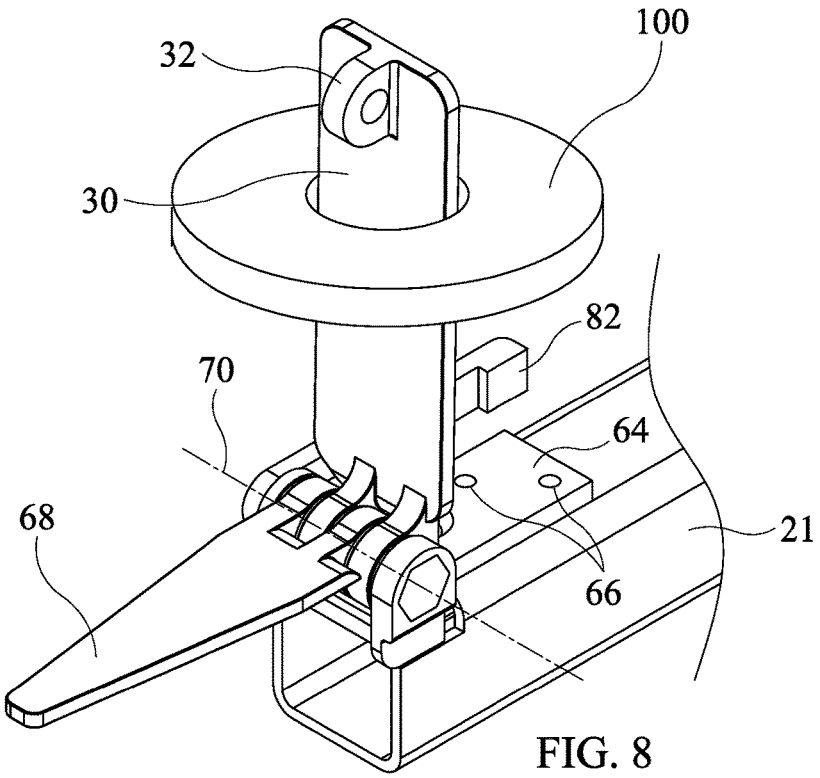
FIG. 8 is a perspective view of the locking hinge arrangement shown in FIG. 5 with the weight-plate-and-resistance-band support member fitted through a weight plate's hole and with a resistance band coupled thereto.
Figure 9:
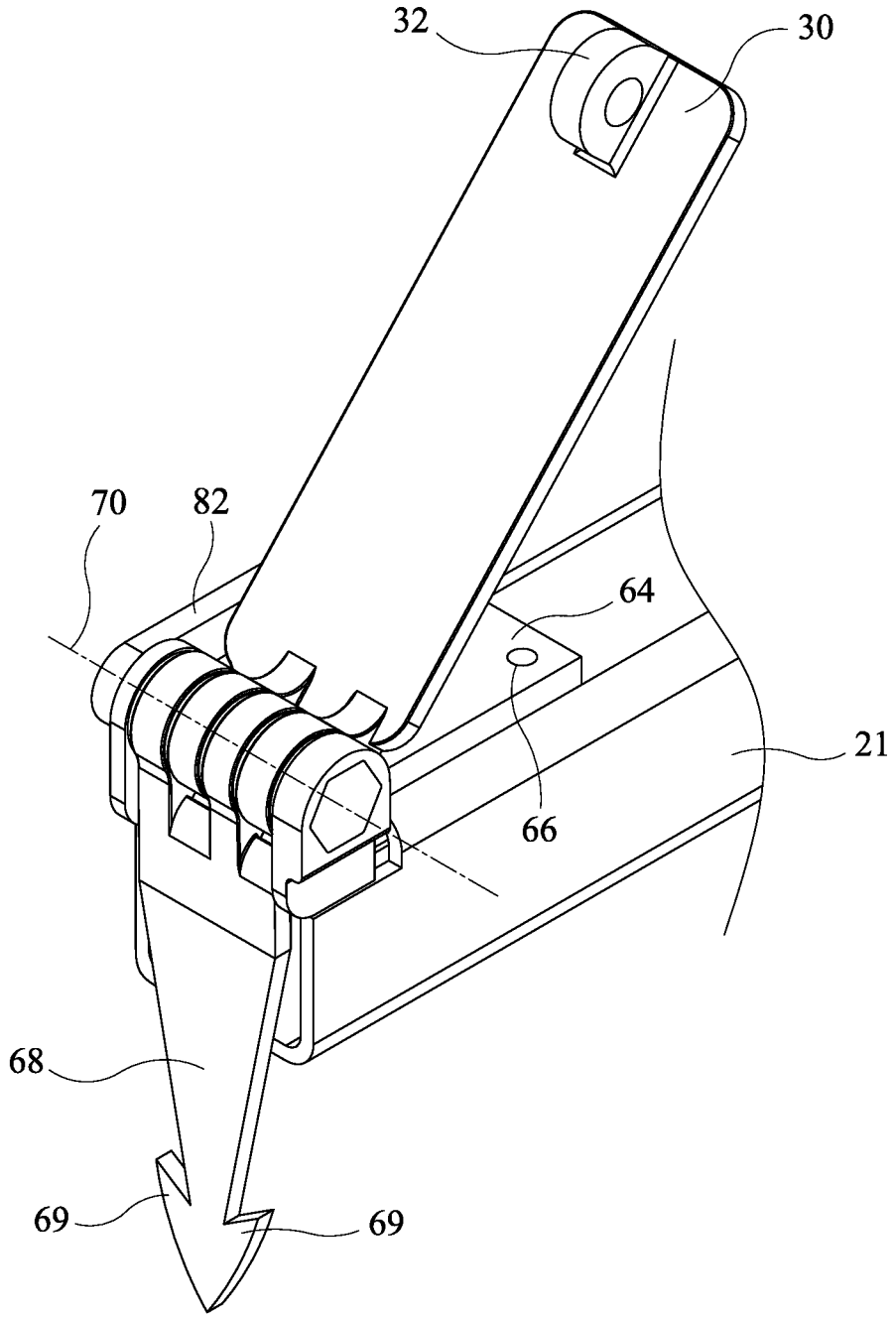
FIG. 9 is a perspective view of a locking hinge arrangement having a barbed-tip spike in accordance with another embodiment of the present invention.

Support member 30, attachment plate 64, and spike 68 can be laid flat against one another (as shown in FIG. 5) when the present invention is not in use. In use, spike 68 and support member 30 can be rotated to a desired position relative to leg member 21. For example, spike 68 can be rotated to be parallel with the top of leg member 21 as shown in FIG. 6 to provide support for a weight (not shown in FIG. 6) placed on the apparatus when in use. As shown in FIG. 7, support member 30 can be rotated to be perpendicular relative to leg member 21 such that a weight plate 100 (FIG. 8) can be placed over the top thereof as explained earlier herein. For clarity of illustration, weight plate 100 is shown as it would be during the process of engagement with support member 30. Spike 68 can also be rotated to point perpendicularly downward relative to leg member 21 as shown in FIG. 7 to facilitate being pressed into a soft ground. For hard floor use, spike 68 can be rotated to be parallel with the top of leg member 21 as shown in FIG. 8 to provide additional support for weight plate 100 as it comes to rest on leg member 21 and spike 68. Regardless of the selected positions of support member 30 and spike 68, their selected positions are locked in place using hinge locking arm 82. To enhance the present invention's soft ground retention feature, spike 68 can be barbed at its tip 69 as shown in FIG. 9.

Figure 10:
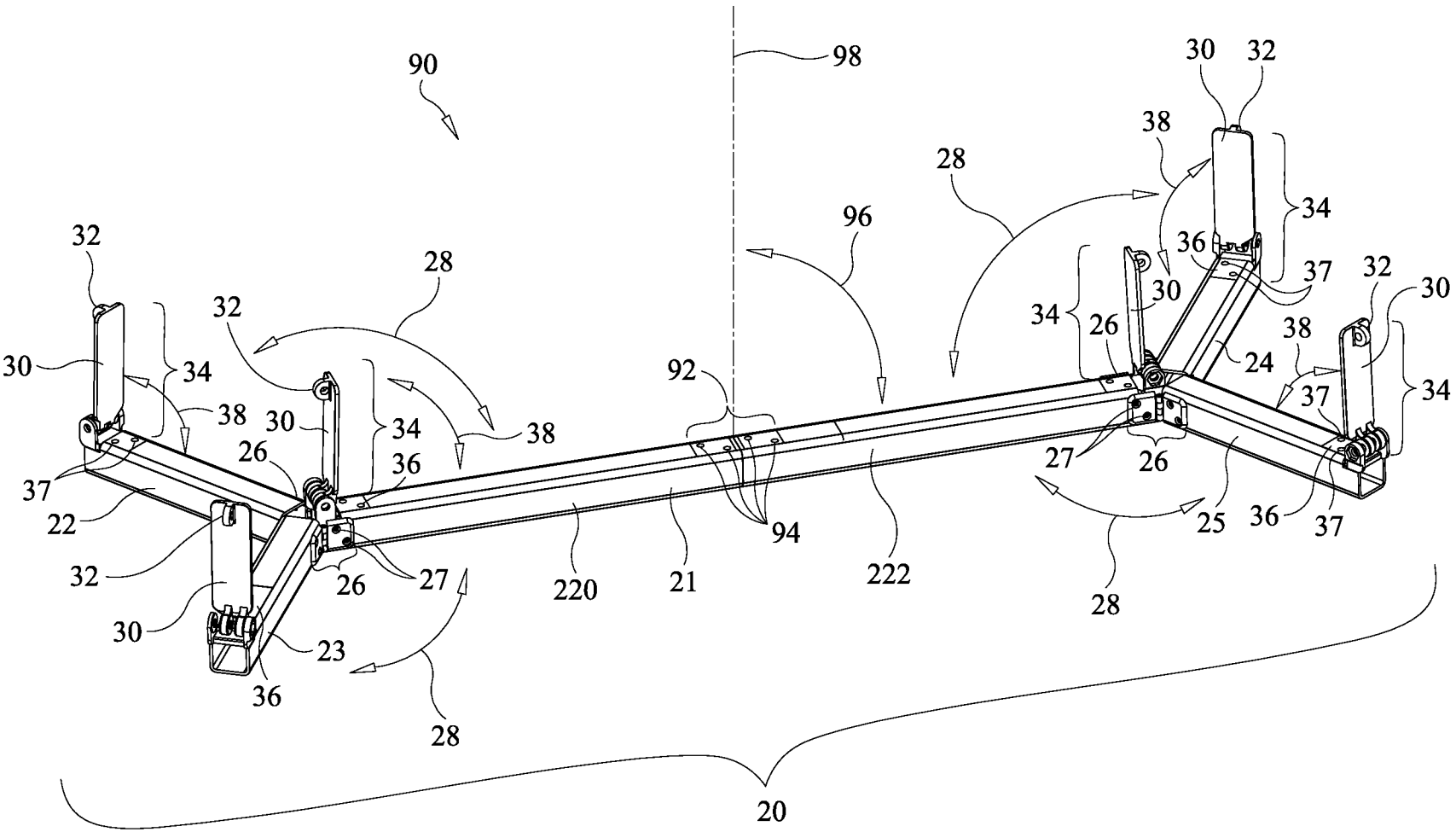
FIG. 10 is a perspective view of a collapsible and transportable apparatus for support of exercise activities hinged along its common leg in accordance with another embodiment of the present invention.

Another embodiment of the present invention is shown in FIG. 10 where an apparatus 90 can be configured to lie flat on a horizontal surface as in the previously-described embodiments, but can also be configured to cooperate with a floor-to-wall interface. As illustrated, apparatus 90 is a modification of the above-described apparatus 40 (FIG. 2). However, it is to be understood that the modifications presented by apparatus 90 could also be incorporated into apparatus 10 (FIG. 1), apparatus 50 (FIG. 3), or apparatus 60 (FIG. 4), without departing from the scope of the present invention.

In apparatus 90, common leg member 21 is configured as two half leg members 220 and 222 joined together by a hinge 92 coupled to half leg member 220 and half leg member 222 by, for example, screws 94. Hinge 92 allows frame 20 to lie flat as shown. Hinge 92 also allows half of frame 20 that originates with half leg member 222 to be rotated (as indicated by two-headed arrow 96) such that leg member 222 is perpendicular to half leg member 220 where such perpendicularity is indicated by dashed line 98. In this way, apparatus 90 can be configured for positioning on a floor at the base of a wall where half leg member 220 and leg members 22/23 rest on the floor, while half leg member 222 and leg members 24/25 rest against the adjoining wall. In other embodiments of the present invention, hinge 92 can be configured as a stiff hinge, a lockable hinge, etc., such that the angular relationship between half leg members 220/222 does not require apparatus 90 to cooperate with or be positioned against a wall. Furthermore, it is to be understood that leg members 220 and 222 could be different lengths without departing from the scope of the present invention. Thus, it is to be understood that regardless of whether leg members 220 and 222 are the same of different lengths, apparatus 90 allows a user to position eye elements 32 at a variety of vertical locations to support additional resistance-band exercise options.

Figure 11:
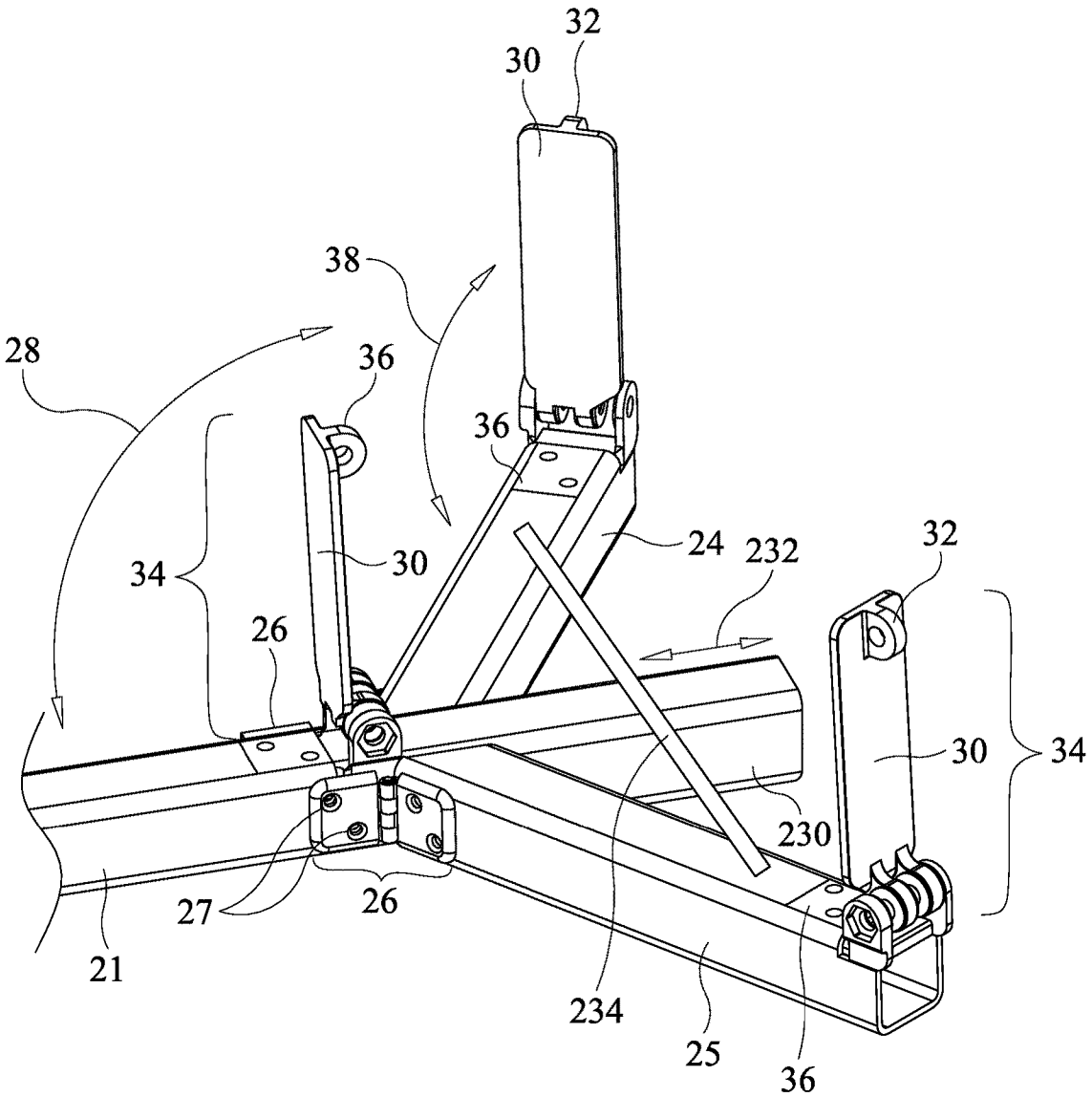
FIG. 11 is a perspective view of a portion an apparatus for support of exercise activities in which the frame's common leg is extendible to form part of a weight support platform in accordance with another embodiment of the present invention.

As described above, common leg member 21 can be configured to be extendible in length. FIG. 11 presents an additional or alternative extendible-length option for common leg member 21 that provides additional weight support functionality for anchoring an apparatus of the present invention. In FIG. 11, one end of previously-described apparatus 40 (FIG. 2) is illustrated with the modification that includes common leg member 21 having an extension 230 that can slide into or out of one end of a completely or partially hollow common leg member 21 as indicated by two-headed arrow 232. When extended as shown, extension 230 lies between leg members 24/25 such that all three lie in the same plane that will be parallel to a supporting floor/ground surface. Although not required, one (or more) support slats 234 can be laid across and coupled to one or more of extension 230 and leg members 24/25. This arrangement provides a support "platform" so that a user can place objects thereon to weight down the apparatus. Such objects could include, for example, bag(s) of sand, rock, etc., cinder block(s), etc., the choice of which is not a limitation of the present invention. It is to be understood that the opposing end of the apparatus between leg members 22/23 (not shown in FIG. 11) could be configured to include the same modification. It is also to be understood that the FIG. 11 modification could be incorporated into any of the previously-described embodiments without departing from the scope of the present invention.

The advantages of the present invention are numerous as the various embodiments thereof provide a mobile, lightweight, strong, and compact exercise apparatus that allows users to attach resistance bands and other equipment to provide a high intensity workout platform. When configured with the collapsible features, the present invention is easy to store and transport. When configured in its use position, resistance bands can be attached using several configurations and accessories thereby allowing the user to achieve high-quality resistance workouts at home, outside, in gyms, etc., to suit their preference, schedule, and ability.

Although the invention has been described relative to specific embodiments thereof, there are numerous variations and modifications that will be readily apparent to those skilled in the art in light of the above teachings. For example, the frame portion of the present invention could be configured in other geometric shapes that can also be constructed in a collapsible fashion. It is therefore to be understood that, within the scope of the appended claims, the invention may be practiced other than as specifically described.

What is claimed as new and desired to be secured by Letters Patent of the United States is:

1. An apparatus for support of exercise activities, comprising:

a frame having a first Y-shaped portion adjoining a second Y-shaped portion wherein said first Y-shaped portion and said second Y-shaped portion share a common leg having opposing ends, and wherein each of said first Y-shaped portion and said second Y-shaped portion has two outboard ends, said first Y-shaped portion and said second Y-shaped portion to include said common leg sharing a common top and a common bottom arranged in planes parallel to the horizontal ground surface and adapted for placement on the horizontal ground surface; and a support member coupled to each of said opposing ends of said common leg, each of said two outboard ends of said first Y-shaped portion, and each of said two outboard ends of said second Y-shaped portion, each said support member being adapted to fit through a hole in a weight plate and adapted to have an exercise resistance band coupled thereto.

2. The apparatus as in claim 1, wherein said common leg is extendible in length.

3. The apparatus as in claim 2, wherein said common leg is extendible between said two outboard ends of said first Y-shaped portion and between said two outboard ends of said second Y-shaped portion.

4. The apparatus as in claim 1, wherein each said support member is hingedly coupled to a corresponding one of said opposing ends of said common leg, said two outboard ends of said first Y-shaped portion, and said two outboard ends of said second Y-shaped portion.

5. The apparatus as in claim 1, further comprising a spike coupled to each of said two outboard ends of said first Y-shaped portion and each of said two outboard ends of said second Y-shaped portion, wherein each said spike is adapted to be pressed into a ground region.

6. The apparatus as in claim 1, further comprising:

a hinge coupled to each of said two outboard ends of said first Y-shaped portion and each of said two outboard ends of said second Y-shaped portion, each said hinge having a corresponding one said support member coupled thereto; and a spike coupled to each said hinge, wherein said support member and said spike coupled to said hinge are independently rotatable there about.

7. The apparatus as in claim 1, wherein said common leg comprises a first leg and a second leg, and wherein said apparatus further comprises a hinge for hingedly coupling said first leg to said second leg.

8. An apparatus for support of exercise activities, comprising:

a first member having a first end and a second end;

a second member coupled on one end thereof to said first end of said first member;

a third member coupled on one end thereof to said first end of said first member, wherein said first member, said second member, and said third member are configured in a first Y-shape;

a fourth member coupled on one end thereof to said second end of said first member;

a fifth member coupled on one end thereof to said second end of said first member, wherein said first member, said fourth member, and said fifth member are configured in a second Y-shape;

said first member, said second member, said third member, said fourth member, and said fifth member sharing common top and a common bottom arranged in parallel planes and adapted for placement on a horizontal ground surface, wherein said parallel planes are parallel to the horizontal ground surface; and a support member coupled to each of said first end of said first member, said second end of said first member, said second member, said third member, said fourth member, and said fifth member, each said support member being adapted to fit through a hole in a weight plate and adapted to have an exercise resistance band coupled thereto.

9. The apparatus as in claim 8, wherein said first member is extendible in length.

10. The apparatus as in claim 9, wherein said first member is extendible at said first end thereof to lie between said second member and said third member, and wherein said first member is extendible at said second end thereof to lie between said fourth member and said fifth member.

11. The apparatus as in claim 8, wherein said second member and said third member are hingedly coupled to said first end of said first member, and wherein said fourth member and said fifth member are hingedly coupled to said second end of said first member.

12. The apparatus as in claim 8, wherein each said support member is hingedly coupled to a corresponding one of said first end of said first member, said second end of said first member, said second member, said third member, said fourth member, and said fifth member.

13. The apparatus as in claim 8, further comprising a spike coupled to each of said second member, said third member, said fourth member, and said fifth member, wherein each said spike is adapted to be pressed into a ground region.

14. The apparatus as in claim 8, further comprising:

a hinge coupled to each of said second member, said third member, said fourth member, and said fifth member, each said hinge having a corresponding one said support member coupled thereto; and a spike coupled to each said hinge, wherein said support member and said spike coupled to said hinge are independently rotatable there about.

15. The apparatus as in claim 8, wherein said first member comprises:

a first portion coupled to said second member and said third member;

a second portion coupled to said fourth member and said fifth member; and a hinge for hingedly coupling said first portion to said second portion.

16. An apparatus for support of exercise activities, comprising:

a frame including a first member having a first end and a second end, a second member coupled on one end thereof to said first end of said first member, a third member coupled on one end thereof to said first end of said first member, wherein said first member, said second member, and said third member are configured in a first Y-shape, a fourth member coupled on one end thereof to said second end of said first member, a fifth member coupled on one end thereof to said second end of said first member, wherein said first member, said fourth member, and said fifth member are configured in a second Y-shape; and a support member hingedly coupled to said frame at each of said first end of said first member, said second end of said first member, said second member, said third member, said fourth member, and said fifth member, each said support member being rotatable to a position approximately perpendicular to said frame wherein each said support member is adapted to have a weight plate engage said support member and rest on said frame, each said support member including an attachment element adapted to have an exercise resistance band coupled thereto as the weight plate rests on said frame.

17. The apparatus as in claim 16, wherein said second member and said third member are hingedly coupled to said first end of said first member, and wherein said fourth member and said fifth member are hingedly coupled to said second end of said first member.

18. The apparatus as in claim 17, wherein said first member has a length L, and wherein each of said second member, said third member, said fourth member, and said fifth member has a length less than L/2.

19. The apparatus as in claim 16, wherein said first member is extendible in length.

20. The apparatus as in claim 19, wherein said first member is extendible at said first end thereof to lie between said second member and said third member, and wherein said first member is extendible at said second end thereof to lie between said fourth member and said fifth member.

21. The apparatus as in claim 16, wherein said first member has a length L, and wherein each of said second member, said third member, said fourth member, and said fifth member has a length less than L/2.

22. The apparatus as in claim 16, further comprising a spike coupled to each of said second member,
said third member,
said fourth member, and
said fifth member, wherein each said spike is adapted to be pressed into a ground region.

23. The apparatus as in claim 16, wherein said first member comprises:

a first portion coupled to said second member and said third member;

a second portion coupled to said fourth member and said fifth member; and a hinge for hingedly coupling said first portion to said second portion.

* * * * *